US008081194B2

(12) United States Patent
Johansson

(10) Patent No.: US 8,081,194 B2
(45) Date of Patent: Dec. 20, 2011

(54) METHOD FOR ENHANCING COLOUR RESOLUTION AND DEVICE EXPLOITING THE METHOD

(75) Inventor: Karl-Anders Johansson, Malmo (SE)

(73) Assignee: Sony Ericsson Mobile Communications AB, Lund (SE)

( * ) Notice: Subject to any disclaimer, the term of this patent is extended or adjusted under 35 U.S.C. 154(b) by 841 days.

(21) Appl. No.: 12/088,264

(22) PCT Filed: Sep. 5, 2006

(86) PCT No.: PCT/EP2006/066023

§ 371 (c)(1),
(2), (4) Date: Mar. 27, 2008

(87) PCT Pub. No.: WO2007/039379

PCT Pub. Date: Apr. 12, 2007

(65) Prior Publication Data

US 2008/0252656 A1 Oct. 16, 2008

Related U.S. Application Data

(60) Provisional application No. 60/725,608, filed on Oct. 11, 2005.

(30) Foreign Application Priority Data

Sep. 28, 2005 (EP) ..... 05108958

(51) Int. Cl.
*G09G 5/02* (2006.01)

(52) U.S. Cl. ..... 345/600; 345/589; 345/605; 345/611; 382/299

(58) Field of Classification Search ..... None
See application file for complete search history.

(56) References Cited

U.S. PATENT DOCUMENTS

| | | | | |
|---|---|---|---|---|
| 5,600,764 | A * | 2/1997 | Kakutani | 345/591 |
| 6,008,796 | A | 12/1999 | Vaswani et al. | |
| 7,342,688 | B2 * | 3/2008 | Chen et al. | 358/3.04 |
| 2002/0109702 | A1 | 8/2002 | Kobayashi | |

FOREIGN PATENT DOCUMENTS

| | | |
|---|---|---|
| EP | A-1 387 319 | 2/2004 |

OTHER PUBLICATIONS

International Preliminary Report on Patentability, date of completion of report Sep. 24, 2007.
European Search Report of EP 05 108 958.9.
International Search Report of PCT/EP2006/066023, mailed Nov. 11, 2006.

* cited by examiner

*Primary Examiner* — Antonio Caschera
(74) *Attorney, Agent, or Firm* — Renner, Otto, Boisselle & Sklar, LLP

(57) ABSTRACT

The invention relates to a method for enhancing color resolution and particularly for obtaining bit resolution in a display using a bits per pixel system frame buffer. The invention uses logic to create intermediate pixel values between bpp color values. The invention proposes to store the image in the system frame buffer always with a fixed number of bits and using Error Diffusion Dither. Then a postprocessing filter is provided to provide the enhanced color resolution using a greater number of bits per pixel as accepted by the display means. The invention also relates to a device exploiting the method.

25 Claims, 3 Drawing Sheets

METHOD FOR ENHANCING COLOUR RESOLUTION AND DEVICE EXPLOITING THE METHOD

FIELD OF THE INVENTION

The present invention relates to a method for enhancing colour resolution and particularly for obtaining 18 bit resolution in a display using a 16 bits per pixel system frame buffer. The invention uses logic to create intermediate pixel values between 16 bits per pixel colour values.

The invention also relates to a device exploiting the method.

STATE OF THE ART

There is a strong demand from the market to provide high colour depth, e.g. 18 bits per pixel, bpp, on a mobile phone display. Today, most mobile phones are already provided with such a high resolution display.

A colour display is composed of picture elements, pixels, which are controlled by pixel values for the basic colours, red, green and blue RGB. Normally, in 16 bpp colour resolution red gets 32 levels, green gets 64 levels, and blue gets 32 levels. This results in 32×64×32=65536 possible colours. Similarly, in 18 bpp colour resolution red gets 64 levels, green gets 64 levels (the same) and blue gets 64 levels. This results in 64×64×64=262144 possible colours. The display is controlled by a display driver means receiving pixel values from a system frame buffer. To achieve true 18 bpp colour on current phones, all colours actually need to be saved using 24 or 32 bits per pixel in the system frame buffer. This is because the processor (CPU) and graphics hardware can only comfortably handle easy pixel sizes such as 8, 16, 24 or 32 bits per pixel.

In the prior art the colour resolution of the system frame buffer is always higher than the colour resolution of the display. Examples of pixel formats in the system frame buffer are:

18 bpp stored in 4 bytes (with 14 dummy bits added)

24 bpp stored in 3 bytes 32 bpp stored in 4 bytes (same as 24 bpp but with 8 dummy bits added).

Thus, with 32 bits per pixel it is necessary to use twice as much memory when storing all pixels and images in 32 bit rather than in 16 bit. Also, the software is more complicated as special mode switching must be performed by software because some applications do not work in other than 16 bit mode.

One way of perceptually increasing the colour depths in an image is called Error Diffusion Dither. The technique will be described below with reference to FIGS. 3 and 4. With this technique a slow gradient in an image is stored at discrete levels but spread out over the gradient.

An example of a prior art method is shown in FIG. 1A. This is the traditional 16 bpp (=65536 colours) system. An application supplies an original image, e.g. a JPEG image with 24 bit colour resolution. This is decoded to 16 bpp with Error Diffusion Dither and stored in the system frame buffer having a resolution of 16 bpp. Before the image can be displayed the data has to be transferred to the display driver. The display today often has 18 bpp colour resolution. The display driver expands the 16 bpp pixel values to 18 bpp by means of simple padding and stores the pixels as 18 bpp in a display frame buffer. The result can now be shown on the display. As the padding does not add colour depth, the colour resolution is still 16 bpp, even if the Error Diffusion Dither perceptually has improved the appearance.

Another example of a prior art method is shown in FIG. 1B. This is the traditional true 18 bpp (=262144 colours) system. The system frame buffer is changed to from 16 bpp to 24 or 32 bpp colour resolution for the reason stated above. All drawing operations must be reconfigured to work with the new colour depth. An application supplies an original image, e.g. a JPEG image with 18 or 24 bit colour resolution. This is decoded to 24 or 32 bpp bit (possibly with Error Diffusion Dither) and stored in the system frame buffer having a resolution of 18, 24 or 32 bpp. The data is transferred to the display driver with a display having 18 bpp colour resolution. The display driver truncates the 24 or 32 bpp pixel values to 18 bpp and stores the pixels as 18 bpp in the display frame buffer. The truncation is performed by hardware for all pixels on a pixel by pixel basis. The result can now be shown on the display. The colour resolution is a true 18 bpp.

Thus, the prior art requires a large system frame buffer to achieve true 18 bpp colour resolution. A large amount of data has to be transferred between the system frame buffer and the display frame buffer. Also, some applications only produce 16 bit images which has to be taken care of as a special case resulting in a switching between 16 and 18 bpp in the system software and the display setting. This leads to more complicated software.

SUMMARY OF THE INVENTION

The invention proposes to store the image in the system frame buffer always with a fixed number of bits, suitably with 16 bit colour resolution, and using Error Diffusion Dither. Then a post-processing filter is provided, suitably before the display driver means, to provide the enhanced colour resolution using a greater number of bits per pixel as accepted by the display means, suitably 18 bits per pixel.

In a first aspect the invention provides a method for enhancing colour resolution, comprising the steps of:

inputting an original image into a system frame buffer having a fixed first number of bits per pixel; by means of an error diffusion algorithm having the capacity of producing diffused slow gradients to be stored in the system frame buffer.

According to the invention, the method comprises the steps of:

processing any slow gradients to produce more levels of colour resolution, producing an increased second number of bits per pixel, said second number of bits per pixel being adapted to characteristics of a display means; and sending processed pixel values to the display means using said second number of bits per pixel.

Suitably, said second number of bits per pixel is the maximum number of bits per pixel of the display means.

In one embodiment, the processing step involves averaging pixel values of a neighbourhood of pixels surrounding the pixel whose pixel value is being processed.

Preferably, if there is a too high variation between neighbouring levels in any of the colours, the average is not used.

In alternative embodiments, if one of the R, G or B pixels deviate more than 1 or 2 steps from the average, the average is not used.

Suitably, the averaged pixel value is truncated to the nearest lower half-step.

Preferably, the number of averaged pixel values is a power of two.

Preferably, colour components of the pixel values are averaged together.

Preferably, the neighbourhood of pixels is two-dimensional.

Suitably, said first number of bits per pixel is 16.

Suitably, said second number of bits per pixel is 18.

In a second aspect the invention provides a device comprising: a control unit with processing power and a display driver means; storage means including a system frame buffer; a display means controlled by the display driver means and having pixels capable of displaying picture element based on a pixel value, wherein the control unit is arranged to input an original image into the system frame buffer with a fixed first number of bits per pixel; by means of an error diffusion algorithm having the capacity of producing diffused slow gradients to be stored in the system frame buffer.

According to the invention, processing logic is arranged to process any slow gradients to produce more levels of colour resolution, producing an increased second number of bits per pixel, said second number of bits per pixel being adapted to characteristics of the display means; and to send processed pixel values to the display means using said second number of bits per pixel.

Suitably, said second number of bits per pixel is the maximum number of bits per pixel of the display means.

In one embodiment, the processing step involves averaging pixel values of a neighbourhood of pixels surrounding the pixel whose pixel value is being processed.

Preferably, if there is a too high variation between neighbouring levels in any of the colours, the average is not used.

In alternative embodiments, if one of the R, G or B pixels deviate more than 1 or 2 steps from the average, the average is not used.

Suitably, the averaged pixel value is truncated to the nearest lower half-step.

Preferably, the number of averaged pixel values is a power of two.

Preferably, colour components of the pixel values are averaged together.

Preferably, the neighbourhood of pixels is two-dimensional.

Suitably, said first number of bits per pixel is 16.

Suitably, said second number of bits per pixel is 18.

In one embodiment, the processing logic is implemented by means of hardware or firmware/microcode in the display driver means.

In another embodiment, the display driver means is integrated on a driver chip together with the display means.

In a further embodiment, the display driver means is integrated on a base band chip communicating with the display means.

In a still further embodiment, the processing logic is implemented by means of hardware or firmware/microcode in a separate unit before the display driver means.

The device may be a portable telephone, a pager, a communicator, a smart phone, or an electronic organiser.

BRIEF DESCRIPTION OF THE DRAWINGS

The invention will be described in detail below with reference to the accompanying drawings in which.

DETAILED DESCRIPTION OF PREFERRED EMBODIMENTS

The invention is applicable in devices with a display and in which the available memory space and processing power are limited. As non-limiting examples the invention may be exploited in portable telephones, pagers, communicators, smart phones and electronic organizers. The display and other electronic and logic components may be conventional. Also how to achieve colour by means of picture elements, pixels, based on the basic colours, red, green and blue, possibly transposed from another colour space, is common knowledge. This specification will concentrate on aspects relevant to the invention.

It is generally desired to save memory space, particularly in small portable devices. 16 bit colour resolution generally produces an adequate colour resolution. The only time when 16 bits does not provide enough colour resolution is in the case of very subtle colour variations, such as "slow" gradients. This is an area in the image in which one or more colour components vary very slowly. In this case the human eye should not perceive any discontinuities, such as segmentations produced by the Error Diffusion Dither algorithm. Otherwise, the human eye can under no circumstances see the difference between two nearby colours in 16 bit resolution when they are not presented right next to one another. By "nearby" is meant that the pixel values of red, green or blue have at the maximum deviated by one level up or down.

In order to store slow gradients with few levels and still retain some information about the gradient Error Diffusion Dither is used. As is common knowledge, this dithering step by itself will greatly improve the perceived quality of the image compared to simply rounding or truncating levels.

Figure 3:
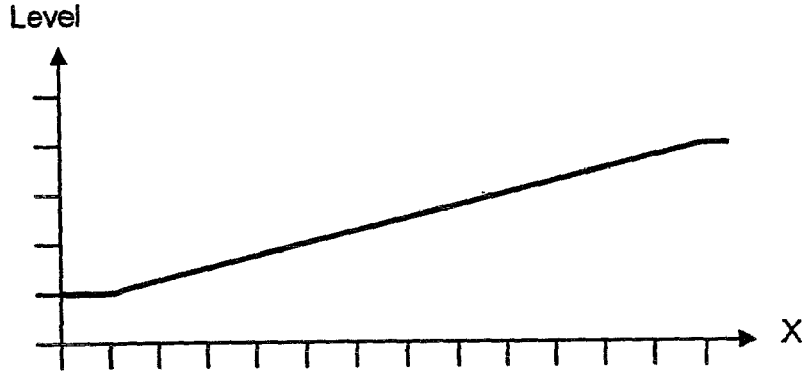
FIG. 3 is a diagram of an intended slow gradient in an image.

An example will be described with reference to FIGS. 3 and 4. The Error Diffusion Dither algorithm is known as such. In this case we would like to draw a gradient from level 1 to level 4, covering 12 pixels. For simplicity we consider only a grey scale image. FIG. 3 is a diagram of such a gradient.

Figure 4:
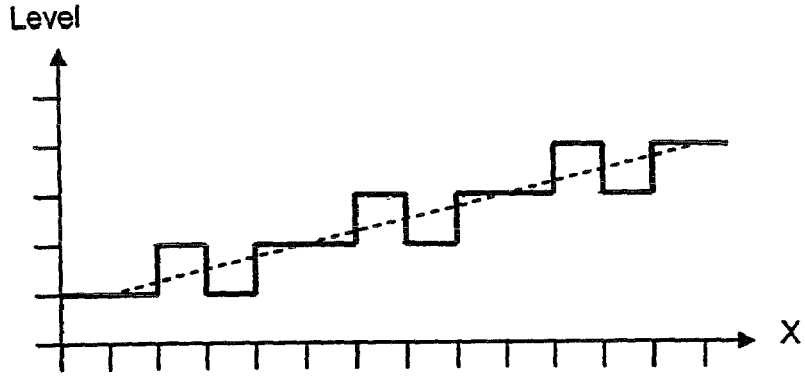
FIG. 4 is a diagram of a gradient after being subjected to Error Diffusion Dither.

Using an Error Diffusion Dither algorithm, this will result in something like the curve shown in FIG. 4. Instead of just increasing the level in three steps, there is an added "diffusion" in that the pixel values are not strictly increasing but increasing and decreasing around the original gradient maintaining the average value of neighbouring pixels around the curve. In this way more information about the original curve is maintained. If this curve is reproduced in a display, it will be perceived as smoother than a curve just increasing the level in three steps.

According to the present invention, a post-processing filter is used to recreate the "intent" of the error diffusion algorithm by examining the neighbourhood of a pixel. If there are only small variations in the value, the variation is most likely the result of trying to produce a level that would normally not be reproducible with the current colour resolution. In that case, the intended colour value can be obtained by calculating the average of the neighbouring pixels. The result of the averaging is not written to the system frame buffer, but sent to the display driver or display frame buffer as described more in detail below.

Figure 5:
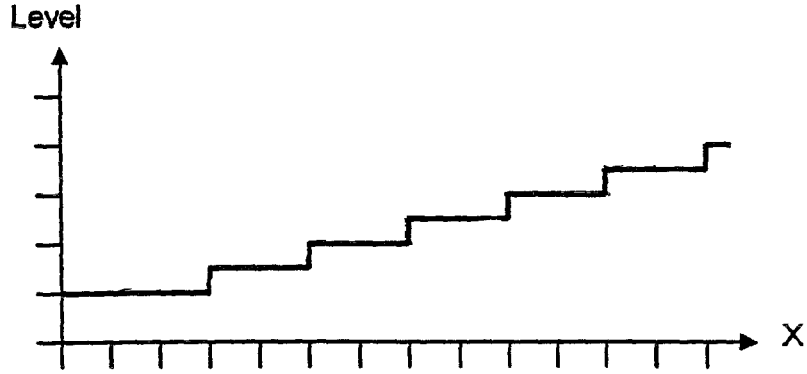
FIG. 5 is a diagram of recreated gradient levels according to the invention.

In this example, by using a one-dimensional neighbourhood of ±1 pixel, the levels shown in FIG. 5 would be obtained. Since we use 3 pixels, the level sum is divided by 3 and the result is then truncated to the nearest lower half-step to double the number of levels. Half steps are sufficient in the case of going from 16 bpp to 18 bpp where the numbers of levels are doubled for the R and B components. Generally, smaller steps may be used. In a real case it would be preferable to choose a neighbourhood consisting of a number of pixels that is a power of 2 to simplify the division.

As soon as there is a too high variation between neighbouring levels in any of the colours, we do not calculate the average since this would introduce blurring artefacts. In other words, a high variation indicates that there is no slow gradient in the image and a discontinuity in the reproduced colours is in fact desirable to obtain adequate sharpness. Thus, a threshold is introduced limiting when the averaging should be performed. For example, if one of the R, G or B pixels deviate more than 1 or 2 steps from the average, the average should not be used. The threshold and average calculations should preferably be applied to the RGB colour components together as an entity.

Also, the choice of neighbourhood determines how many levels it is possible to recreate. E.g., by using a two-dimensional neighbourhood of 2 by 2 pixels, four times the number of levels can be achieved, which effectively would allow a perceived "22 bits" colour resolution (+7+8+7 bits for R, G, B).

Figure 1A:
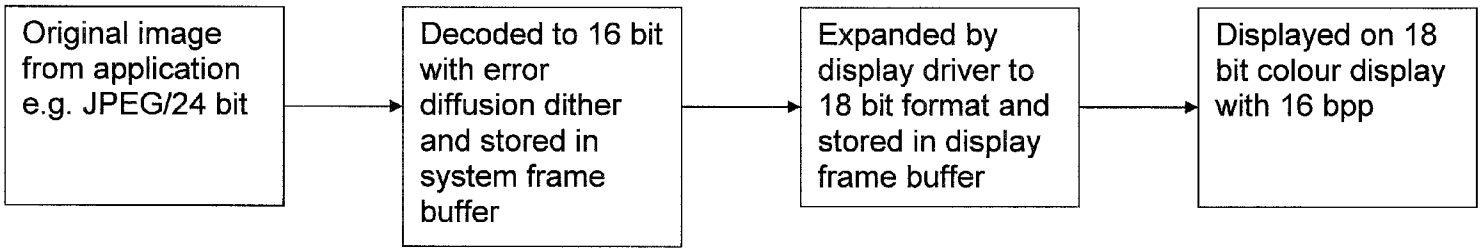
Prior art FIG 1A
FIGS. 1A and 1B are flow diagrams of prior art methods.
Figure 1B:
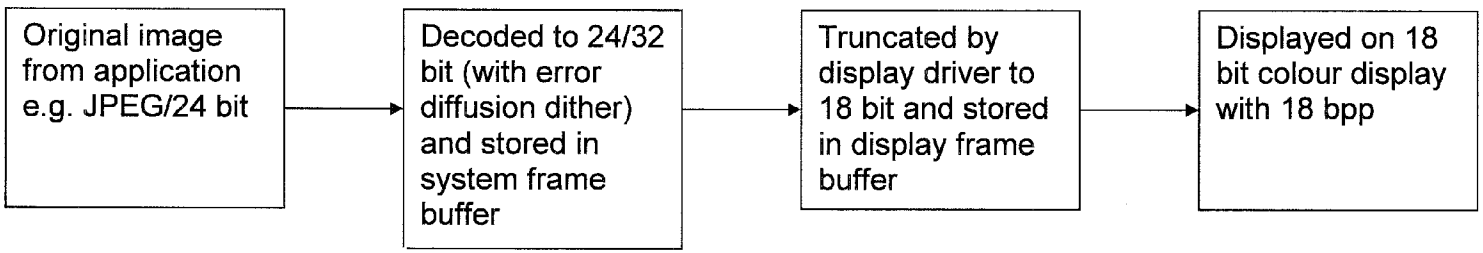
Prior art FIG 1B
Figure 2:
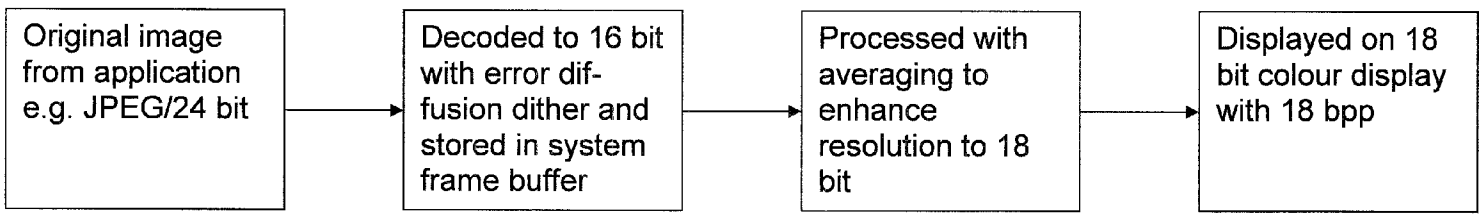
FIG. 2 is a flow diagram of the method according to the invention.

The method according to the invention is outlined in FIG. 2 with an enhancement from 16 bpp to 18 bpp as an example. An application such as a camera supplies an original image, e.g. a JPEG image with 24 bit colour resolution. The image data is unpacked to raw image data and stored in the system frame buffer, suitably a video RAM. The original image has a high depth colour resolution and the JPEG unpacker may provide a 24 bpp colour resolution. Storing this original size in the system frame buffer is not desired. Instead the image is decoded "on the fly" to 16 bpp colour resolution with error diffusion dither and stored in the system frame buffer. Preferably, the system frame buffer stores the 16 bpp pixel values in 2 bytes each to optimise the memory space requirement.

In order to recreate slow gradients the averaging described above is performed. This averaging reproduces or reinvents colour levels simulating the original slow gradient resulting in 18 bpp pixel values. The averaging is performed in a unit placed before the display driver. In an alternative the display driver performs the averaging. If no averaging is performed which is the case outside slow gradients, the 16 bit pixel values are filled with zeroes, also resulting in 18 bpp pixel values. Instead of storing the 18 bit pixel values for each pixel in the system frame buffer, these values are sent directly to the 18 bpp colour display. The colour resolution will be a (simulated) 18 bpp.

Thus, the total number of colours in the image stored in the system frame buffer is e.g. 65536 colours. By means of the invention colour gradients or transitions are found that could be enhanced in colour levels. The image stored in the system frame buffer includes segments of colours due to the coarser levels and error diffusion dither, but the new processed image is provided with more colour levels to smooth out the segmentation. By means of the invention more colours, e.g. 262144 colours with 18 bits per pixel, may be produced, but requires much less memory.

Figure 6:
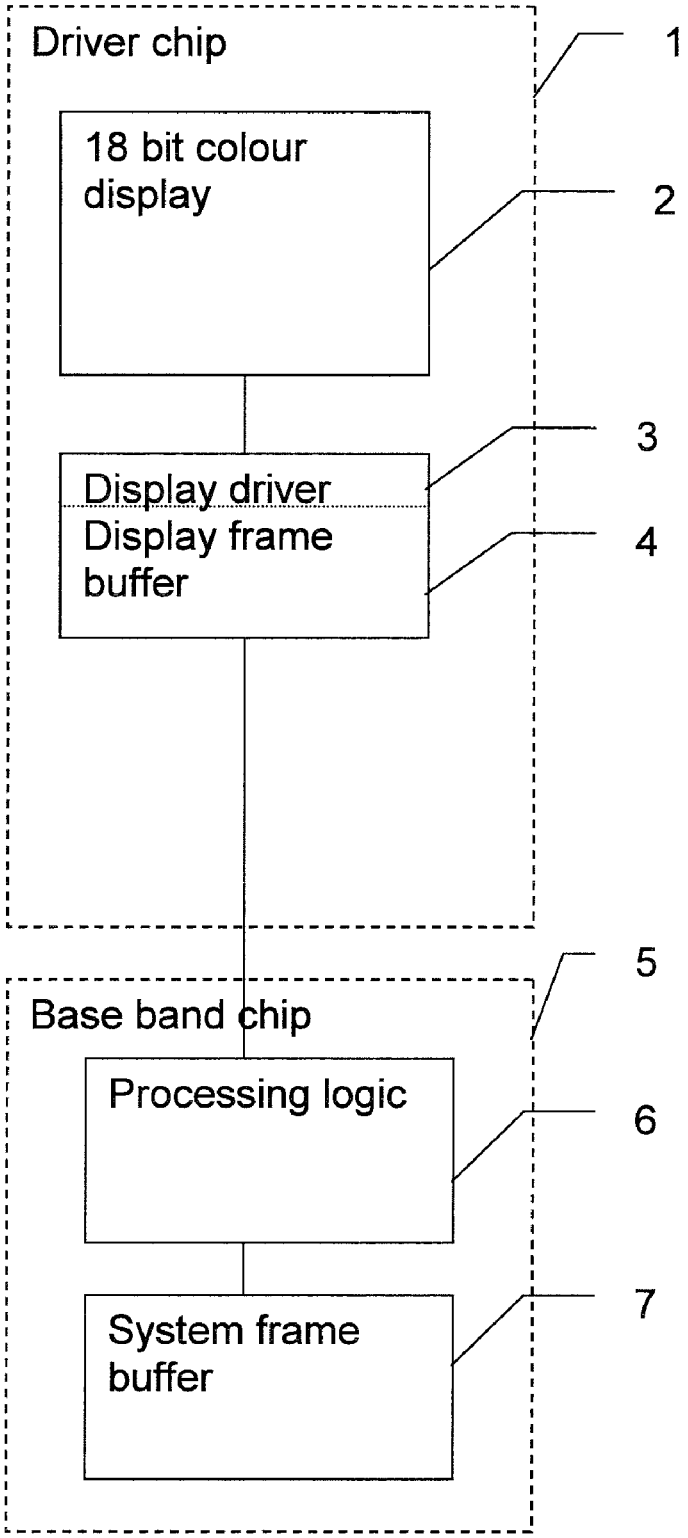
FIG. 6 is a schematic diagram of a device according to the invention.

FIG. 6 is a schematic diagram of relevant components of a device incorporating the invention. In a device such as a mobile telephone, a control unit and storage including a system frame buffer 7, such as video RAM are usually provided on a main/base band chip 1 while the display is provided as a separate component, here shown as provided on a driver chip 1. The system frame buffer may alternatively be provided on an external RAM. The driver chip 1 comprises display driver means 3 comprising a display frame buffer 4 containing the data shown on the display 2. The logic 6 to perform the processing is suitably implemented as hardware or firmware/microcode on the main chip 5. Suitably, the processing logic 6 is incorporated in a physical display interface responsible for transferring data from the system frame buffer 7 to the display driver 3. Alternatively, the display frame buffer may be incorporated on the main chip or in an external RAM.

In a further embodiment, the processing logic writes the image data enhanced to 18 bpp in an intermediary 24/32 bpp buffer (not shown) before being sent to the display driver.

In an alternative, the processing logic 6 may be integrated with the display driver means 3 on the driver chip 1 or possibly as a separate component between the main chip 5 and the display driver means 3 (not shown).

The calculations necessary to perform the processing are relatively easy and are well suited for fast operation. Thus, the images mentioned in this specification may be frames in a video sequence.

The present invention enables an enhanced colour resolution while using only 16 bit colour resolution in the system frame buffer. The enhanced 18 bit colour resolution is not stored in the system frame buffer, but sent directly to the display driver. Since the frame buffer always has 16 bit colour resolution, all applications may be optimised to this and no switching between 16 bpp and 18 bpp is necessary which results in simplified software. The smaller 16 bit system frame buffer will also allow for faster writing and reading of data.

The invention may be implemented by means of a suitable combination of hardware and software. The colour resolutions 16 and 18 bits discussed in the specification are currently preferred examples but the invention is not limited to these values. The scope of the invention is only limited by the claims below.

The invention claimed is:

1. A method for enhancing colour resolution of an original image presented on a display, comprising the steps of:

using a control unit decoding the original image by means of an error diffusion dithering algorithm having the capacity of producing diffused slow gradients;

storing the decoded image in a system frame buffer having a fixed first number of bits per pixel;

wherein the original image has a number of levels of colour resolution; and wherein the method further comprises the steps of:

processing pixel values of said decoded image to recreate slow gradients in the original image to produce more levels of colour resolution than the number of levels of colour resolution of the original image, wherein the processing step involves averaging pixel values of a two-dimensional neighbourhood of pixels surrounding the pixel whose pixel value is being processed;

producing an increased second number of bits per pixel, said second number of bits per pixel being adapted to characteristics of the display; and using processing logic sending processed pixel values to the display using said second number of bits per pixel.

2. A method according to claim 1, wherein said second number of bits per pixel is the maximum number of bits per pixel of the display means.

3. A method according to claim 1, wherein if there is a too high variation between neighbouring levels in any of the colour components R, G or B of the pixel values, respectively, the averaged pixel value is not used.

4. A method according to claim 3, wherein if one of the R, G or B pixels value deviate more than 1 step from the average, the averaged pixel value is not used.

5. A method according to claim 3, wherein if one of the R, G or B pixels value deviate more than 2 steps from the average, the averaged pixel value is not used.

6. A method according to claim 1, wherein the averaged pixel value is truncated to the nearest lower half-step.

7. A method according to claim 1, wherein the number of averaged pixel values is a power of two.

8. A method according to claim 1, wherein said averaging pixel values comprises averaging together the colour components of the pixel values.

9. A method according to claim 1, wherein said first number of bits per pixel is 16.

10. A method according to claim 1, wherein said second number of bits per pixel is 18.

11. A device comprising:

a control unit with processing power;

a display driver;

storage means including a system frame buffer;

a display controlled by the display driver and having pixels capable of displaying picture elements based on pixel values, wherein the control unit is configured to decode an original image by an error diffusion dithering algorithm having the capacity of producing diffused slow gradients and storing the decoded image in the system frame buffer, with a fixed first number of bits per pixel, wherein the control unit includes processing logic configured:

to process the pixel values of an original image having a number of levels of colour resolution, to recreate slow gradients in the original image to produce more levels of colour resolution within the original image, wherein the processing step involves averaging pixel values of a two-dimensional neighbourhood of pixels surrounding the pixel whose pixel value is being processed;

to produce an increased second number of bits per pixel, the second number of bits per pixel being adapted to characteristics of the display; and to send processed pixel values to the display using the second number of bits per pixel.

12. A device according to claim 11, wherein said second number of bits per pixel is the maximum number of bits per pixel of the display means.

13. A device according to claim 11, wherein if there is a too high variation between neighbouring levels in any of the colour components, R, G or B of the pixel values, the averaged is not used.

14. A device according to claim 13, wherein if one of the colour components R, G or B of the pixels value deviate more than 1 step from the average pixel value, the average is not used.

15. A device according to claim 13, wherein if one of the colour components R, G or B of the pixels value deviate more than 2 steps from the averaged pixel value, the average is not used.

16. A device according to claim 11, wherein the averaged pixel value is truncated to the nearest lower half-step.

17. A device according to claim 11, wherein the number of averaged pixel values is a power of two.

18. A device according to claim 11, wherein the processing logic is configured to carry out the processing step involving averaging pixel values by averaging together the colour components of the pixel values.

19. A device according to claim 11, wherein said first number of bits per pixel is 16.

20. A device according to claim 11, wherein said second number of bits per pixel is 18.

21. A device according to claim 11, wherein the processing logic is implemented by means of hardware or firmware/microcode in the display driver means.

22. A device according to claim 21, wherein the display driver means is integrated on a driver chip together with the display means.

23. A device according to claim 21, wherein the display driver means is integrated on a base band chip communicating with the display means.

24. A device according to claim 11, wherein the processing logic is implemented by means of hardware or firmware/microcode in a separate unit before the display driver means.

25. A device according to claim 11, wherein the device is a portable telephone, a pager, a communicator, a smart phone, or an electronic organiser.

* * * * *